US009895710B2

(12) United States Patent
Ma

(10) Patent No.: US 9,895,710 B2
(45) Date of Patent: Feb. 20, 2018

(54) CONSTRUCTION MEMBER WITH VIBRATING ROD

(71) Applicant: Yihe Ma, Xiangfan (CN)

(72) Inventor: Yihe Ma, Xiangfan (CN)

( * ) Notice: Subject to any disclaimer, the term of this patent is extended or adjusted under 35 U.S.C. 154(b) by 0 days.

(21) Appl. No.: 15/508,930

(22) PCT Filed: Jul. 9, 2016

(86) PCT No.: PCT/CN2016/089499
§ 371 (c)(1),
(2) Date: Mar. 6, 2017

(87) PCT Pub. No.: WO2017/008711
PCT Pub. Date: Jan. 19, 2017

(65) Prior Publication Data

US 2017/0274404 A1 Sep. 28, 2017

(30) Foreign Application Priority Data

Jul. 13, 2015 (CN) ..... 2015 2 0502730 U

(51) Int. Cl.
*B01F 11/00* (2006.01)
*B05B 17/06* (2006.01)
*E04G 21/04* (2006.01)
*E04B 2/84* (2006.01)

(52) U.S. Cl.
CPC ..... *B05B 17/0607* (2013.01); *B01F 11/008* (2013.01); *E04G 21/04* (2013.01); *E04B 2/84* (2013.01)

(58) Field of Classification Search
CPC ..... E04G 21/08; B01F 11/008; B01F 11/0082
USPC ..... 366/120–123, 154.2
See application file for complete search history.

(56) References Cited

U.S. PATENT DOCUMENTS 3,363,806 A * 1/1968 Blakeslee ..... B65D 88/66 222/202
4,483,695 A * 11/1984 Covey, Jr. ..... B01D 17/04 210/188
5,309,405 A * 5/1994 Brett ..... B06B 1/16 181/106

(Continued)

FOREIGN PATENT DOCUMENTS

CN 102011491 A 4/2011
CN 102733608 A 10/2012
CN 204386612 U 6/2015

(Continued)

*Primary Examiner* — Charles Cooley
(74) *Attorney, Agent, or Firm* — Gokalp Bayramoglu

(57) ABSTRACT

A construction member 3D printing spray head with vibrating rod which includes a frame, a receiving hopper, a vibrating rod and a lifting device; the vibrating rod includes a cylindrical vibrating body and cable wires connected to the cylindrical vibrating body. The lifting device includes a set of guide wheels, clamp, wire rope, electrical winding drum. Wherein, the cylindrical vibrating body is located within the receiving hopper. The cable wire which is connected to the cylindrical vibrating body extends outside the receiving hopper via the space between the wheels of the set of guide wheels arranged above the receiving hopper. One side of the clamp clamps the cable wire that is outwardly extended, while the other side of the clamp clamps the wire rope. The wire rope is wrapped around the electrical winding drum.

2 Claims, 1 Drawing Sheet

(56) References Cited

U.S. PATENT DOCUMENTS

| | | | | |
|---|---|---|---|---|
| 6,015,225 | A * | 1/2000 | Williams | B01F 11/0068 366/114 |
| 2017/0274404 | A1 * | 9/2017 | Ma | B05B 17/0607 |

FOREIGN PATENT DOCUMENTS

| | | | |
|---|---|---|---|
| CN | 204781983 | U | 11/2015 |
| EP | 0289720 | A2 | 11/1988 |
| JP | H06248798 | | 9/1994 |

* cited by examiner

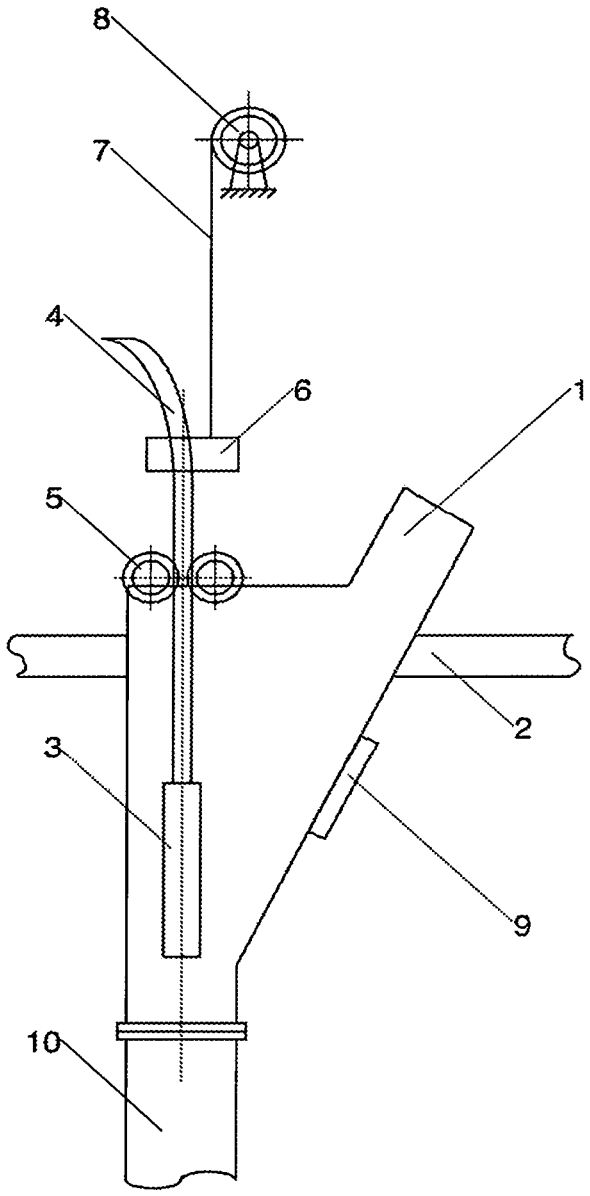
8
7
4
6
1
5
2
3
9
10

CONSTRUCTION MEMBER WITH VIBRATING ROD

CROSS REFERENCE TO RELATED APPLICATIONS

This application is the national phase entry of International Application No. PCT/CN2016/089499, filed on Jul. 9, 2016, which is based upon and claims priority to 201520502730.1 filed on Jul. 13, 2015, the entire contents of which are incorporated herein by reference.

TECHNICAL FIELD

The present application relates to an apparatus for transporting concrete used in building construction, in particular, to a construction member 3D printing spray head with vibrating rod.

BACKGROUND

In the prior art, most of the external wall, the thermal insulation, the external wall decoration of construction projects are substantially built step by step. The external wall construction requires inner/outer formwork, and the thermal insulation and external wall decoration need to set up scaffolds. There are downsides of complicated construction procedures, long construction period, and large wastes. To accommodate the requirements of 3D printing of building wall, and for printing an integrated building wall with an external wall, a reserved thermal insulating space, and an external wall decoration, the following requirements need to be met at the same time. First, the concrete slurry cannot be too thin. Thin concrete slurry is hard to set, and makes the task of ensuring the strength of the concrete difficult to accomplish. Second, the concrete material cannot be too thick. If the concrete is too thick, the fluidity becomes poor. Thick concrete material will be hard to cast, and will also affect the quality of the concrete wall. The problem that the concrete slurry cannot be too thin and the concrete material cannot be too thick is a dilemma expected to be solved.

SUMMARY

The object of the present application is to provide a construction member 3D printing spray head with vibrating rod with regard to the defects of the prior art.

The present application is achieved through the following technical solutions:

Comparing the technical solution of the present application with the prior art, the beneficial effects are as follows. A construction member 3D printing spray head with vibrating rod includes a frame, a receiving hopper, a vibrating rod and a lifting device. The vibrating rod includes a cylindrical vibrating body and a cable wire connected to the cylindrical vibrating body. The lifting device includes a set of guide wheels, a clamp, a wire rope, and an electrical winding drum. The cylindrical vibrating body is located within the receiving hopper. The cable wire is connected to the cylindrical vibrating body and extends outside the receiving hopper via the space between the wheels of the set of guide wheels arranged above the receiving hopper. One side of the clamp clamps the cable wire that outwardly extends, while the other side of the clamp clamps the wire rope. The wire rope is wrapped around the electrical winding drum. The electrical winding drum and the receiving hopper are fixed on the frame.

The side wall of the receiving hopper is fixedly provided with a flat vibrator.

Comparing with the prior art, the construction member 3D printing spray head with vibrating rod provided by the present invention has the following advantages. The present application improves the fluidity of the concrete by vibrating the vibrating rod and the flat vibrator. The vibrating is based on the premise that the technical parameters of the concrete batching do not change. Thus, the efficiency of the 3D printing spray head is guaranteed, and the printing time is shortened, such that the needs of printing construction members are fully met.

BRIEF DESCRIPTION OF THE DRAWINGS

The FIGURE is a structural schematic drawing of an embodiment of the present application.

DETAILED DESCRIPTION

Hereinafter, the embodiments of the present application are further described. The FIGURE is a structural schematic drawing of an embodiment of the present application. In the FIGURE, a construction member 3D printing spray head with vibrating rod includes a frame 2, a receiving hopper 1, a vibrating rod and a lifting device. The vibrating rod includes a cylindrical vibrating body 3 and cable wire 4 connected to cylindrical vibrating body 3. The lifting device includes a set of guide wheels 5, clamp 6, wire rope 7, and electrical winding drum 8. Cylindrical vibrating body 3 is located within receiving hopper 1. Cable wire 4 which is connected to cylindrical vibrating body 3, extends outside receiving hopper 1 via the space between the wheels of the set of guide wheels 5 arranged above receiving hopper 1. One side of clamp 6 clamps cable wire 4 that is outwardly extended, while the other side of clamp 6 clamps wire rope 7. Wire rope 7 is wrapped around electrical winding drum 8. Electrical winding drum 8 and receiving hopper 1 are fixed on frame 2. When the cylindrical vibrating body of the present structure is powered-up, the concrete inside the receiving hopper moves downward along the pipeline along with the upward and downward traction of the wire rope in the electrical winding drum.

The present application further takes the following measures. The side wall of the receiving hopper is fixedly provided with a plate vibrator 9. The plate vibrator mounted on the side wall of the receiving hopper helps the downward movement of the concrete piled up on the side wall. Under the dual effects of the vibrating rod and the plate vibrator, the fluidity of the concrete has been improved.

The present application can further take the following measures. The outlet of the receiving hopper is connected to a connector 10 which can be a hose or a 360-degree rotatable printing spray head with the rotary pair.

When in use, the present application is fixed on the base of the printing spray head of the 3D printer. The present application moves along the x-axis, y-axis, and z-axis via the base of the printing spray head according to the requirement of the digital controlling device of the printer, so that any construction member can be printed smoothly.

The structure of the present application is described above with reference to the accompanying drawings and embodiments, which does not constitute limitations on the present application. One skilled in the art can make adjustments according to the actual need. Various variations and modifications that are made within the scope of the appended claims all fall within the scope of protection.

What is claimed is:

1. A construction member 3D printing spray head with vibrating rod, comprising: a frame, a receiving hopper, a vibrating rod and a lifting device, the vibrating rod including a cylindrical vibrating body and a cable wire connected to the cylindrical vibrating body, the lifting device including a set of guide wheels, a clamp, wire rope, an electrical winding drum, the cylindrical vibrating body being located within the receiving hopper, the cable wire which is connected to the cylindrical vibrating body extending outside the receiving hopper via the space between wheels of the set of guide wheels arranged above the receiving hopper, a side of the clamp clamping the cable wire that extends outwardly, another side of the clamp clamping the wire rope, the wire rope being wrapped around the electrical winding drum, the electrical winding drum and the receiving hopper being fixed on the frame.

2. The construction member 3D printing spray head with vibrating rod according to claim 1, wherein a plate vibrator is fixed on a side wall of the receiving hopper.

* * * * *